US005499908A

United States Patent [19]

Schmitz, III

[11] Patent Number: 5,499,908

[45] Date of Patent: Mar. 19, 1996

[54] METHOD OF MAKING FOAM IN AN ENERGY EFFICIENT COMPRESSOR

[75] Inventor: Raymond J. Schmitz, III, Tecumseh, Mich.

[73] Assignee: Tecumseh Products Company, Tecumseh, Mich.

[21] Appl. No.: 954,265

[22] Filed: Sep. 30, 1992

[51] Int. Cl.[6] ..... F04B 21/00; F04B 17/00; F01M 11/08

[52] U.S. Cl. ..... 417/368; 417/312; 184/6.23

[58] Field of Search ..... 417/368, 312; 184/6.23

[56] References Cited

U.S. PATENT DOCUMENTS

| | | | |
|---|---|---|---|
| 2,990,111 | 6/1961 | Bohn | 230/232 |
| 3,480,205 | 11/1969 | Hatten | 230/232 |
| 4,127,994 | 12/1978 | Niven | 62/469 |
| 4,352,642 | 10/1982 | Murayama et al. | 417/312 |
| 4,545,743 | 10/1985 | Earley | 417/372 |
| 4,730,988 | 3/1988 | Ma | 417/313 |
| 4,747,471 | 5/1988 | Ballentine | 184/6.18 |
| 4,750,864 | 6/1988 | Bayyouk | 416/203 |
| 4,829,786 | 5/1989 | Sand | 62/468 |
| 4,946,611 | 8/1990 | Kaneko | 252/49.6 |
| 4,959,169 | 9/1990 | McGraw | 252/68 |
| 5,021,179 | 6/1991 | Zehler et al. | 252/54.6 |
| 5,053,155 | 10/1991 | Mahler | 252/68 |
| 5,152,926 | 10/1992 | Brown | 252/32.5 |

*Primary Examiner*—Richard A. Bertsch
*Assistant Examiner*—A. Basichas
*Attorney, Agent, or Firm*—Baker & Daniels

[57] ABSTRACT

An energy efficient hermetic compressor for compressing hydrofluorocarbon refrigerants. The compressor includes a motor compressor unit with a rotating oil pickup tube to which an oil paddle is attached. The oil paddle rotates in a base lubricant of polyol ester mixed with a siloxane ester foaming agent. The combination of the foaming additive with the oil paddle creates a foam layer that floats in the oil sump to reduce the sound level of the compressor.

24 Claims, 3 Drawing Sheets

METHOD OF MAKING FOAM IN AN ENERGY EFFICIENT COMPRESSOR

BACKGROUND OF THE INVENTION

The present invention relates generally to hermetic compressors and more particularly to energy efficient compressors using fluorocarbon refrigerants. An area of interest in the compressor art is how to construct a more efficient and quieter compressor.

One area that has received attention is that of noise generation and suppression within the compressor system. A majority of compressors include suction and discharge valves that open and close thereby creating noise. This noise is irritating and disruptive, particularly in residential applications of compressor systems.

It is well known that if oil within the compressor is caused to froth or foam, there is a reduction in the sound transmitted from the compressor. Accordingly, an impeller, generally in the form of paddles, has been placed on the lubricant pickup tube for oil foam generation thus reducing noise of the unit. An example of this is shown in U.S. Pat. No. 4,747,471.

For many years the refrigerant of choice in hermetic refrigeration compressors has been dichlorodifluoromethane, $CCl_2F_2$, commonly referred to as Refrigerant R-12. Recently, the scientific community has come to recognize certain environmental hazards associated with the wide-spread use of chlorofluorocarbons (CFC's) such as R-12, and particularly in regard to its adverse effect on the ozone layer. In recent years, efforts have been made to find a substitute for R-12 that is environmentally acceptable, and that may be utilized in most refrigeration applications without requiring substantial modification of the refrigeration equipment. Tetrafluoroethane refrigerants, such as R134a (1,1,1,2 tetrafluoroethane), have been identified as acceptable substitutes for R-12 in a variety of applications, and widespread use of Refrigerant R134a is expected to increase in the future. The thermodynamic properties of R134a are close to those of R-12, and since R134a is free of chlorine, it is believed to be benign to stratospheric ozone.

With the new refrigerant, new types of lubricating oils have been subject to testing. Currently, no one lubricant satisfies the needs of adequate lubrication of the compressor parts and sound reduction within the compressor.

SUMMARY OF THE INVENTION

According to the present invention, it is found that sound is reduced within the compressor by a rotating oil paddle used in conjunction with an oil foaming additive to create an oil foam blanket layer.

In the preferred embodiment of the invention, a compressor having a rotating oil pickup tube is attached with an oil paddle. The oil paddle rotates within the lubricant in the oil sump of the compressor, thereby creating a layer of foam to reduce the sound level of the compressor. Lubricant located within the oil sump is mixed with a controlled quantity of a foaming agent to create the level of foam desired for compressor sound reduction.

In one embodiment of the invention, the base lubricant is a polyol ester or synthetic oil. More specifically, the polyol ester may be a pentaerythritol ester of fatty acids.

In one form of the invention, the foaming agent is a siloxane ester. In a particular form, the foaming agent is a mixture dimethyl, methyl, and polyethylene oxide acetate capped siloxane copolymer.

An advantage of the present invention is that sound reduction is accomplished through a broad range of frequencies. By controlling the concentration of the foaming agent, sound transmitted through the compressor housing is reduced.

Another advantage is that the lubrication system with the foaming agent of the present invention works with non-ozone depleting refrigerants such as R134a. It is foreseen that within a number of years, R-12 production will be ceased thereby necessitating use of different refrigerants such as R134a.

A further advantage of the present invention is that the oil paddle described herein is less expensive than other paddles and easier to manufacture. No oil baffle within the oil sump is needed since no sloshing of the oil is produced. The thick foam blanket formed by the oil paddle and foaming agent effectively reduce compressor sound levels.

An additional advantage of the present invention is that the siloxane ester, used as the foaming agent, also acts as a wetting agent to better lubricate the compressor at start up. This lubricant, with the surfactant, adheres to wear surfaces, providing a minute film to protect the surface during start-up and reducing friction during operation; thereby, reducing power consumption.

Another advantage is that the present invention may be used with refrigerants such as R-32, R-125, R-134a, R-143a and refrigerant blends thereof to reduce the sound level of the compressor.

The invention, in one form thereof, includes a compressor having a housing including an oil sump and hydrofluorocarbon refrigerant therein. A motor compressor unit within the housing compresses the refrigerant. The compressor unit has a rotatable shaft including a mounted oil pickup tube thereon. Base lubricant mixed with a foaming agent is disposed in the oil sump. An oil paddle attached to the oil pickup tube is rotatable within the lubricant. During compressor operation, rotation of the oil paddle causes an oil foam layer to form within the compressor to reduce compressor noise transmitted through the housing.

In one aspect of the previously described form of the invention, the base lubricant is a refined synthetic oil preferably a polyol ester. Preferably the selected polyol ester is a pentaerythritol ester of fatty acids.

In another aspect of one form of the invention, the foaming agent is a siloxane ester in which the volume concentration of the ester relative to the lubricant is approximately 0.10% to 1.0%.

In another form of the invention, the volume concentration of the siloxane ester relative to the lubricant is between 0.25% and 0.5% by volume.

In one form of the invention, the compressor for compressing 1,1,1,2 tetrafluoroethane refrigerant comprises a hermetic housing containing a motor compressor unit having a rotatable shaft in an oil sump. The foaming agent, including a mixture of dimethyl, methyl and polyethylene oxide acetate capped siloxane copolymer is mixed with a base lubricant of pentaerythritol ester disposed within the oil sump. An oil paddle is attached to the rotatable shaft such that the paddle is rotatable on the lubricant whereby an oil foam layer is created to reduce compressor noise.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 1:
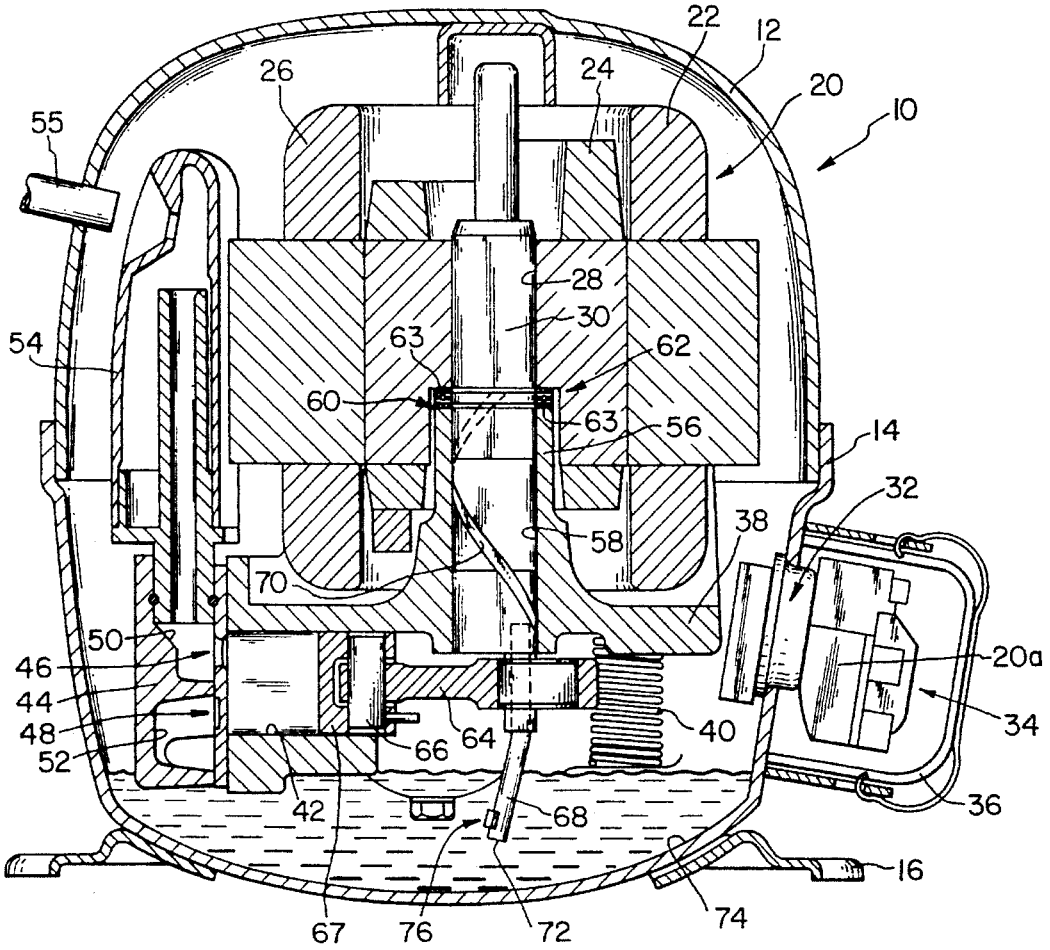
FIG. 1 is a longitudinal sectional view of a compressor of the type to which the present invention pertains.

Corresponding reference characters indicate corresponding parts throughout the several views. The exemplifications set out herein illustrate a preferred embodiment of the invention, in one form thereof, and such exemplifications are not to be construed as limiting the scope of the invention in any manner.

DESCRIPTION OF THE PREFERRED EMBODIMENT

Referring now to FIG. 1, there is shown a compressor having a housing generally designated as 10. The housing has a top portion 12 and a lower portion 14 that are hermetically secured together as by welding or brazing. A foot or bracket 16 is welded to the bottom of housing 10 for mounting the compressor.

Located inside the hermetically sealed housing 10 is a motor generally designated at 20 having a stator 22 and rotor 24. The stator 22 is provided with windings 26. Stator 22 is secured to the support frame or crankcase 38 by means of screws. The rotor 24 has a central aperture 28 provided therein into which is secured crankshaft 30 by an interference fit. A hermetic terminal 32 is provided on bottom portion 14 of the compressor for connecting motor 20, through cluster block 20*a*, to a source of electrical power. As shown in FIG. 1, a motor relay 34 is connected over terminal cluster 32 and a terminal shield 36 covers both terminal cluster 32 and motor relay 34.

Within housing 10 is mounted a support frame or crankcase 38 resiliently suspended within housing 10 by suitable spring mounts such as compression springs 40 connected to crankcase 38 and bottom portion 14 of lower housing 14. Although only one spring is shown, it is to be understood that a number of springs are provided at proper positions to support crankcase 38 within lower housing 14.

Crankcase 38 has a horizontally extending cylinder bore 42 which is sealed off at the end adjacent to housing 10 by cylinder head 44 including a suction valve 46, discharge valve 48, suction plenum 50 and discharge plenum 52. Connected to cylinder head 44 is a suction muffler 54. A suction return tube 55 permits refrigerant to enter compressor from a refrigeration system (not shown). Discharge plenum 52 is in communication with a discharge muffler, shockloop and a discharge tube (not shown) leading out of housing portion 14. From the center of crankcase 38 extending upwardly is a bearing hub 56 defining a vertical bearing bore 58. Bearing hub 56 has an end face 60 facing upwardly on bearing hub 56.

Crankshaft 30 is journalled for rotation within vertical bearing bore 58. A ball thrust bearing device 62 extends radially from crankshaft 30 separated from end face 60 by a thrust washer 63 and, on the other end, from rotor 24 by another thrust washer 63. Bearing 62 rides upon thrust washers 63. A connecting rod 64 is attached to the end of crankshaft 30 that extends through bearing bore 58. Connecting rod 64 is attached to piston pin 66 that fits within cylinder bore 42, and causes piston 67 to reciprocate within cylinder bore 42 as crankshaft 30 rotates.

The reciprocating compressor described herein provides a lubrication system for lubricating the components of the compressor including the crankshaft 30 and bearing 62. An offset oil pickup tube 68 is disposed within crankshaft 30 and is in communication with spiral groove 70 extending around the outer surface 72 of crankshaft 30. Oil pickup tube 68 has an opening 72 that is partially immersed in an oil sump 74. During operation, oil pickup tube rotates within the oil in sump 74 pulling lubricant up into tube 68 and urging it through groove 70.

Figure 2:
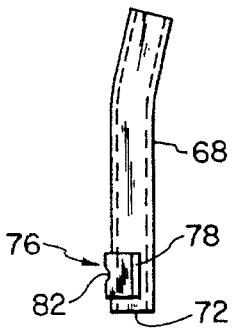
FIG. 2 is a enlarged elevational view of the oil pickup tube with the paddle of the present invention.
Figure 3:
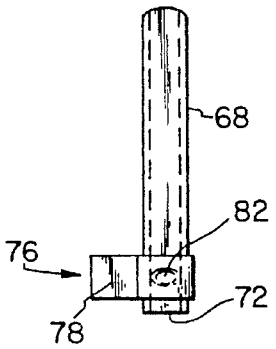
FIG. 3 is a front view of the oil pickup tube and paddle of the present invention.
Figure 4:
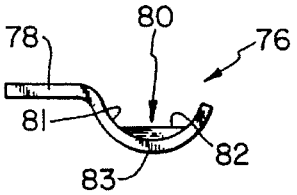
FIG. 4 is a top view of the oil paddle of the present invention.

The present invention includes an oil paddle 76 attached to oil pickup tube 68. Paddle 76 is preferably a strip paddle made from a shaped piece of metal and attached to tube 68 by either welding or brazing. As shown in FIGS. 2–4, paddle 76 includes a flat portion 78 that, when rotated with oil pickup tube 76 within the lubricant of sump 74, causes foam to be produced. Without oil paddle 76, the rotating oil pickup tube 68 does not cause foam. Paddle 76 includes an arcuate portion 80 with inner arcuate surface 81 and an outer surface 83, in the inner surface 81 shaped to conform to tube 68. Paddle 76 is brazed to tube 68 at an attachment point 82. As shown in FIG. 4, attachment point 82 may include an edge to help locate paddle 76 in a notch (not shown) on oil pickup tube 68.

The invention further includes a base lubricant with a controlled quantity of a foaming additive.

The environmental hazards associated with the use of chlorofluorocarbons (CFC's) have been widely reported, and there has been an ongoing search for environmentally-acceptable substitutes. Of particular concern has been the search for an acceptable substitute for Refrigerant R-12 (dichlorodifluoromethane), widely used as a refrigerant in hermetic compressors. R134a, among others, has been identified as a promising substitute for R-12. The physical characteristics of R134a (1,1,1,2 tetrafluoroethane) enable it to be used in place of R-12 in refrigeration compressors, which substitution may be accomplished without requiring substantial changes to be made to the compressor.

Mineral oils have been widely used as lubricants with Refrigerant R-12 in refrigeration compressors. These mineral oils provided sufficient lubrication to the moving parts of the compressor. In addition, the mineral oils were generally fully miscible with R-12 throughout the operating temperature range of the compressor. Mineral oils, however, are almost completely immiscible with R134a. No matter what proportion of oil and refrigerant one employs, the refrigerant and the oil remain as two distinct layers, regardless of temperature. This immiscibility increases the likelihood that the compressor will not be adequately lubricated if a mineral oil lubricant is utilized with R134a, and that the lubricant will not return to the compressor from the evaporator in the refrigeration loop, thereby resulting in the eventual premature failing of the compressor.

Instead of mineral oil lubricants, polyol ester type lubricants along with other types of synthetic oils have been found to work with R134a in a compressor environment.

The polyol esters of choice are the fatty acid esters of pentaerythritol. Although the particular fatty acids used may be straight-chain, branched or a mixture of these, polyol esters of branched chain fatty acids having between about five and about nine carbon atoms are preferred. If acids having more than about nine carbon atoms are used in predominant amounts, the viscosity of the lubricant becomes greater than desired. If the acids have less than about five carbon atoms in the chain in predominant amounts, the viscosity may not be sufficient to properly lubricate the moving parts of the compressor. The lubricant has a greater miscibility in the refrigerant when a branched chain fatty acid is used; however straight chain lubricants, and mixtures of straight and branched chain lubricants may generally also be employed. It is highly desirable, however, that the lubricant be fully miscible in the refrigerant throughout the operating temperature range of the compressor. Therefore, the use of a branched chain fatty acid is preferred.

A particular preferred polyol ester is sold by the Henkel Corp, Emery Group, under the commercial designation of 2927A.

Other readily available polyol esters may be substituted for 2927A, but it is preferred that the fatty acid component is within the general guideline of chain length range discussed above. It is preferred that the viscosity of the polyol ester be between about 29.5 centistokes and 36.0 centistokes at 100° F. Although commercial pentaerythritol esters often contain small amounts of dipentaerythritol esters, this small amount of the dipentaerythritol esters is normally acceptable in the lubricant composition. It is conventional to nonetheless refer to the esters as pentaerythritol esters, notwithstanding the presence of the dipentaerythritol esters. Other polyol esters which may be used as lubricants with R134a are based on trifunctional alcohols such as trimethylol propane (TMP), or even on difunctional alcohols such as neopentyl glycol.

The invention also includes a controlled quantity of an oil foaming agent to help create the sound reducing layer of foam within the compressor. It has been found that a foaming agent of a siloxane ester operates effectively with strip paddle 76 discussed above.

A particular siloxane ester favored by the inventor is sold by Dow Corning, under the commercial designation of silicone additive, DC 57. This particular ester is actually a copolymer containing the ingredients of dimethyl, methyl, and polyethylene oxide acetate capped siloxane copolymer. The oil foaming additive creates an oil foam while the compressor is operating but also serves as a wetting agent, increasing the lubricity of the lubricant and thereby reducing friction within the compressor during startup. The present oil and foaming agent is not compatible with R-12 and mineral oil compressor systems.

In operation, compressor 10 begins functioning as electrical power is supplied to motor 20 causing piston 67 to reciprocate within bore 42.

Motor 20 also rotates oil pickup tube 68 attached to crankshaft 30. Oil paddle 76 rotates with pickup tube 68 causing flat portion 78 to move through the lubricant in sump 74. This rapid rotating movement of paddle 76 causes the lubricant in combination with the siloxane ester additive to foam.

Foam generation can be controlled by varying the speed at which the compressor is operated or by varying the quantity of the oil additive within the lubricant. Normally the operating speed of the compressor motor is not varied.

It has been found that a quantity of siloxane foaming additive of between approximately 0.10% and 1.0% by volume relative to the lubricant creates an adequate supply of sound insulative foam for use in compressors. Concentrations of siloxane ester outside of the above limits tend to decrease the performance of the compressor. Low concentrations do not cause enough foam to be produced or increase the oils lubricity. High concentrations cause too much foaming, increasing the entrained lubricant in the R134a refrigerant.

A foam blanket thickness of between 0.25 and 2 inches is desired. A preferred quantity of siloxane ester is between approximately 0.25% and 0.50% by volume relative to the lubricant, which makes a superior thickness of foam to dampen sound levels within the compressor without negatively impacting compressor performance.

Figure 6:
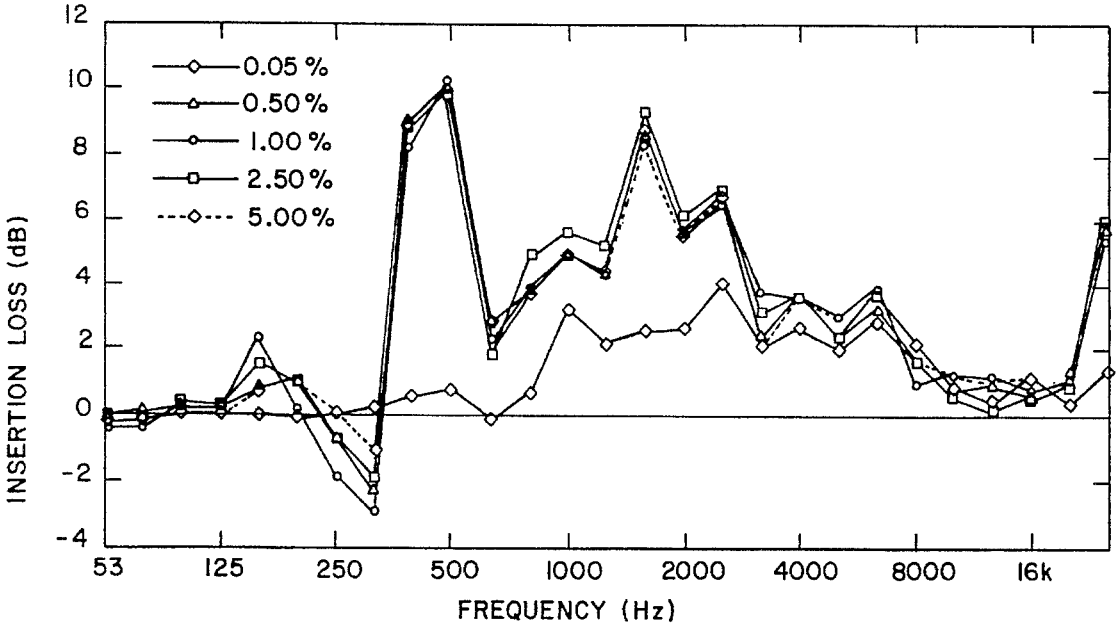
FIG. 6 is a graph of test results showing the sound reduction of the present invention.
Figure 7:
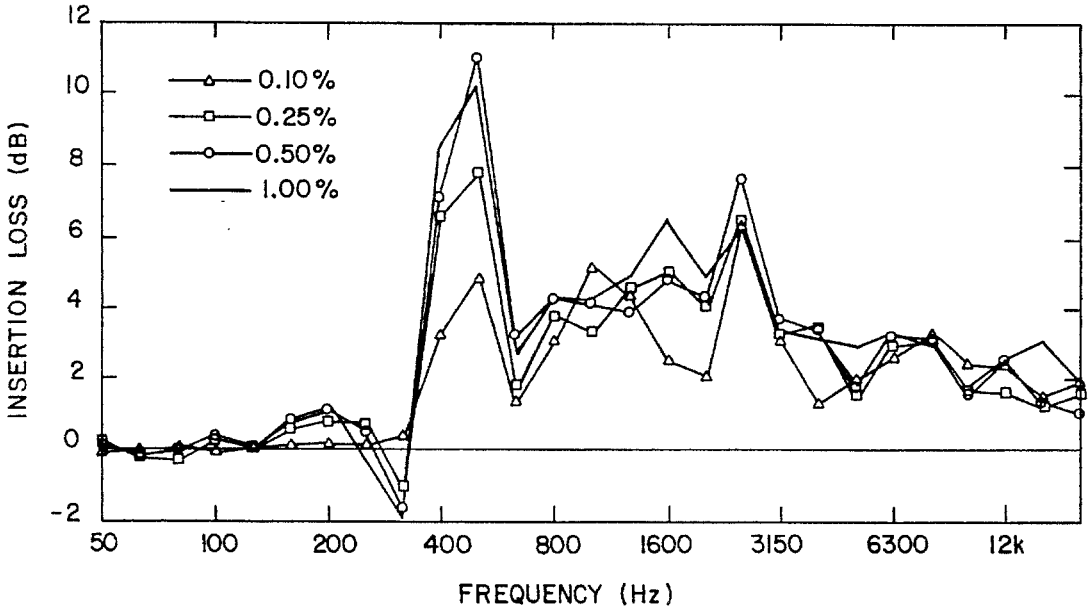
FIG. 7 is another graph of test results showing the sound reduction of the present invention.

As discussed below and as shown in FIGS. 6 and 7, the single best concentration of siloxane foaming agent is approximately 0.50% by volume relative to the lubricant. This concentration, with the lubricant and oil paddle disclosed above, creates the largest sound reduction potential over a broad spectrum of sound frequencies.

TEST RESULTS

Figure 5:
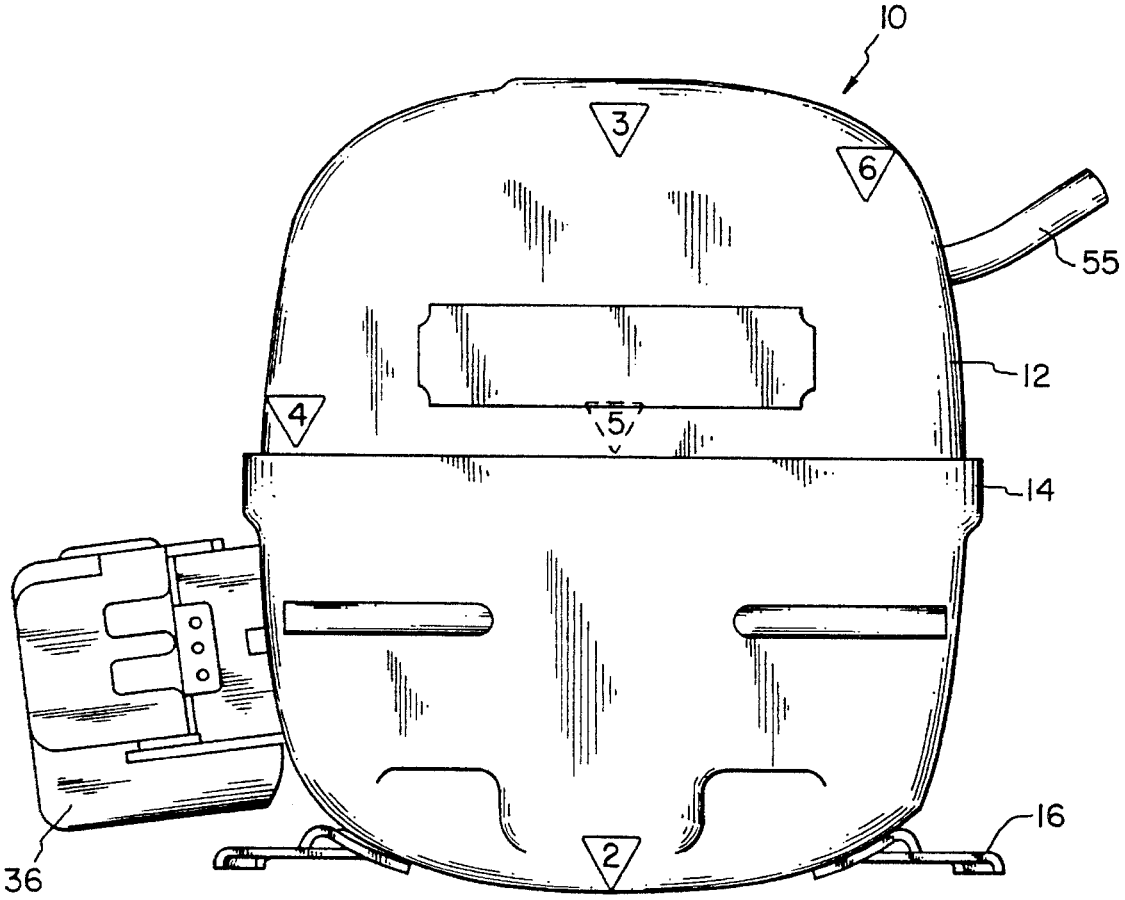
FIG. 5 is elevational view of the test compressor showing the location of microphones.

In order to objectively determine the overall sound reduction inside the compressor with the addition of the siloxane additive, five acoustic microphones (#2–#6) were mounted inside a compressor (FIG. 5). Microphone placement was determined from earlier testing showing the major acoustic resonant modes inside the housing. Note that #2 microphone is under the oil. Since the sound power levels of the four microphones above the oil were so similar, they were averaged to reduce the amount of date presented. In addition, ⅓ octave bands, A-weighted and linear levels were also measured. The insertion losses db (attenuation) from 50 Hz to 20 KHz are shown in FIGS. 6 and 7. The attenuation was derived from the baseline readings taken without additive and the calculated differences among seven different additive concentrations. FIGS. 6 and 7 plot this acoustic data reduction.

The loudest tones from the microphones above the oil are at 400, 800–1250 and 4000 Hz. The foaming agent works to reduce the sound pressure levels at all frequencies, from 400 Hz through 20 KHz. Minimum concentration tested (0.05%) does nearly as well as the maximum (5.0%) above 2500 Hz. Nominal concentration of 0.5% is as good as 5% for all frequencies except 1600 Hz. Above 2500 Hz, no clear pattern is apparent, with all concentrations producing up to 4db of attenuation. Below 2150 Hz, more specifically the 400–500 Hz and 1600–2500 Hz ranges, higher concentrations produce higher attenuation. Little is gained by increasing concentrations of additive from 0.5% to 1.0%.

The loud frequencies measured by microphone #2 under the oil are 315–400 Hz, 800–1250 Hz, 1600–3150 Hz and 6000 Hz. The tones from 1600–3150 Hz and above 5KHz are the loudest recorded for any of the microphones. Higher concentrations of foaming agent lowers the level above 4 KHz, but sound levels were very unsteady. There was little effect below 1000 Hz except at the 400–500 Hz range.

The sound pressure levels below the oil are much higher in the important frequency range above 2500 Hz. Sound transmission through the oil is probably the most important path for major noise problems. The foam layer, created by the foaming agent, causes overall noise reduction and reduced sound transmission when used in conjunction with the oil paddle, polyol ester oil and refrigerant. Without the foaming agent additive, the ester oil will not foam.

The geometry of oil pickup tube 68 and oil paddle 76 do not create a harmful pressure gradient or cause sloshing sounds within the compressor. Because there are no oil sloshing sounds created, no oil baffle is needed within sump 74. During operation, the refrigerant vapor bubble concentration is not high enough to reduce the amount of oil flow to the bearing, therefore all bearings receive adequate lubrication.

Although this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A compressor comprising:

a housing including an oil sump and a hydrofluorocarbon refrigerant therein;

a motor-compressor unit for compressing the hydrofluorocarbon refrigerant, said unit including a rotatable shaft having an oil pickup tube therein;

a polyal ester base lubricant in said oil sump;

a foaming agent mixed with said base lubricant; and an oil paddle attached to said oil pickup tube, said paddle rotatable in said lubricant, whereby an oil foam layer is created during compressor operation to reduce compressor noise.

2. The compressor of claim 1 in which said base lubricant is a refined synthetic oil.

3. The compressor of claim 1 in which said foaming agent is siloxane ester.

4. The compressor of claim 1 in which said polyol ester is a pentaerythritol ester of fatty acids.

5. The compressor of claim 1 in which said foaming agent is a mixture of dimethyl, methyl and polyethylene oxide acetate capped siloxane copolymer.

6. The compressor of claim 1 in which the volume concentration of said foaming agent relative to said lubricant is approximately 0.50%.

7. The compressor of claim 1 in which the volume concentration of said foaming agent relative to said lubricant is 0.25% to 0.50%.

8. The compressor of claim 1 in which the volume concentration of said foaming agent relative to said lubricant is 0.10% to 1.0%.

9. The compressor of claim 1 in which oil paddle is a strip paddle brazed to said oil pickup tube.

10. The compressor of claim 1 in which said hydrofluorocarbon refrigerant is R-134a.

11. The compressor of claim 1 in which said hydrofluorocarbon is one of R-32, R-125, R-134a or R-143a.

12. The compressor of claim 1 in which said hydrofluorocarbon is a blend consisting of two or more of R-32, R-125, R-134a or R-143a.

13. The compressor of claim 1 in which said oil foam layer has a thickness of between 0.25 inches and 2.0 inches.

14. A compressor for compressing 1,1,1,2 Tetrafluoroethane refrigerant, said compressor comprising:

a hermetic housing containing a motor compression unit including a rotatable shaft, said housing including an oil sump;

a supply of a base lubricant of pentaerythritol ester located in said oil sump;

a foaming agent of siloxane ester mixed with said base lubricant;

an oil paddle attached to said shaft, said paddle rotatable in said lubricant, whereby an oil foam layer is created during compressor operation to reduce compressor noise and transmitted through said housing.

15. The compressor of claim 14 in which said siloxane ester foaming agent is a mixture of dimethyl, methyl and polyethylene oxide acetate capped siloxane copolymer.

16. The compressor of claim 14 in which the volume concentration of said foaming agent relative said lubricant is 0.05% to 3.0%.

17. The compressor of claim 14 in which the proportion of said foaming agent relative to said lubricant is 0.25% to 0.50%.

18. The compressor of claim 14 in which said oil foam layer has a thickness of between 0.25 inches and 2.0 inches.

19. A compressor for compressing 1,1,1,2 Tetrafluoroethane refrigerant, said compressor comprising:

a hermetic housing containing a motor compression unit including a rotatable shaft, said housing including an oil sump;

a base lubricant of pentaerythritol ester located in said oil sump;

a foaming agent a mixture of dimethyl, methyl and polyethylene oxide acetate capped siloxane copolymer, said foaming agent mixed with said base lubricant, said foaming agent being less than 1.0% of base lubricant by volume;

an oil paddle attached to said shaft, said paddle rotatable in said lubricant, whereby an oil foam layer is created to reduce compressor noise transmitted through said housing.

20. The compressor of claim 19 in which the volume concentration of said foaming agent relative to said lubricant is 0.25 to 1.0%.

21. The compressor of claim 19 in which the volume concentration of said foaming agent relative to said lubricant is 0.25% to 0.50%.

22. The compressor of claim 19 in which the volume concentration of said foaming agent relative to said lubricant is 0.10% to 1.0%.

23. The compressor of claim 19 in which the volume concentration of said foaming agent relative to said lubricant is approximately 0.50%.

24. The compressor of claim 19 in which said oil foam layer has a thickness of between 0.25 inches and 2.0 inches.

* * * * *